United States Patent [19]

Hansen

[11] 4,007,507

[45] Feb. 15, 1977

[54] BRIDGE COMPOSED OF INDIVIDUAL SECTIONS ASSEMBLED BY MEANS OF AN ASSEMBLING UNIT

[76] Inventor: Carl E. Hansen, Egegaardsvej 33, Roedovre, Denmark, DK-2610

[22] Filed: Nov. 11, 1975

[21] Appl. No.: 630,812

[52] U.S. Cl. ..... 14/17; 52/726; 211/183

[51] Int. Cl.[2] ..... E04C 3/02

[58] Field of Search ..... 14/14, 17; 248/224; 182/222, 223; 211/183, 186; 52/646, 650, 758 R, 758 G, 751, 726

[56] References Cited

UNITED STATES PATENTS

| | | | |
|---|---|---|---|
| 669,979 | 3/1901 | Bucknam | 14/17 X |
| 1,920,831 | 8/1933 | Zabriskie | 52/650 |
| 2,171,326 | 8/1939 | Tarbet | 14/16 J |
| 2,656,223 | 10/1953 | Gray | 182/119 |
| 2,711,805 | 6/1955 | Hallead | 52/758 R |
| 2,975,910 | 3/1961 | Conrad | 52/758 R X |
| 2,993,459 | 7/1961 | Storey | 14/27 X |
| 3,036,539 | 5/1962 | Storey | 14/27 X |
| 3,066,332 | 12/1962 | Sedlacek | 14/14 |
| 3,504,389 | 4/1970 | Longbottom | 14/27 X |
| 3,664,626 | 5/1972 | Sneller | 248/224 |

*Primary Examiner*—Nile C. Byers, Jr.
*Attorney, Agent, or Firm*—John J. Dennemeyer

[57] ABSTRACT

A bridge composed of individual sections is assembled by means of an assembling unit whose support elements comprise two lateral beams, preferably lattice girders. The assembling unit includes a main cross beam which is bolted to the end of one of two adjoining bridge sections and is connected to the end of the next adjoining bridge section by a hinge means having a substantially horizontal axis. Each end of the main cross beam is mounted on a substantially vertical supporting leg.

6 Claims, 3 Drawing Figures

BRIDGE COMPOSED OF INDIVIDUAL SECTIONS ASSEMBLED BY MEANS OF AN ASSEMBLING UNIT

The invention relates to a bridge composed of sections which are assembled by means of an assembling unit whose support elements comprise two lateral beams, preferably lattice girders.

The object of the present invention is to provide a bridge of this type which can be used mainly as a boat bridge or a bathing bridge, and can be easily assembled and disassembled.

The primary feature of the bridge is a cross beam which is bolted to the end of one of two adjoining sections, and is connected to the end of the next adjoining bridge section by a hinge having a substantially horizontal axis. A substantially vertical supporting leg is secured at each end of the cross beam.

The cross beam and the supporting legs provide a firm connection for supporting the sections and a very simple structure of sections is thereby obtained, as these sections may in this case be identical. During assembly the firm connection between the cross beam and the section should be made first. Upon attachment of the second section it is sufficient to lift one end of the sections up and to make the hinge connection. The next step would be to lift up the other end and to attach a new set of supporting legs with a cross beam at that end, and so forth. In this way it is not necessary to lift an entire section at one time. The bridge may furthermore be characterized in providing means for locking the movement of the hinge. In this way a more rigid structure is obtained. During assembly of the bridge the hinge may be turned as mentioned, and when the bridge has been erected and adjusted the locking may be made.

According to the invention the supporting legs may be longitudinally adjustable in such a manner that the distance between the upper point of attachment and the lower point of support can be varied. One can erect thus in a simple manner for instance a bathing bridge at a coast having varying floor conditions, e.g. on a rocky coast.

The bridge may be provided with an additional cross beam which is located underneath the first one and connects two opposite supporting legs in a firm assembly. Thereby the assembly unit consisting of cross beams and supporting legs provides a firm frame structure, which will effectively support the bridge against torsions in its longitudinal direction, and offers the possibility of using sectional units of simple construction without essential torsional rigidity. In this manner a simple and inexpensive bridge structure is obtained.

To stabilize the bridge against turning over, according to the invention, a pair of associated supporting legs is so designed that the distance between the supporting legs increases in the downward direction.

Finally the bridge is characterized in that an individual section may consist only of two lateral beams in the shape of lattice girders, and that a deck consisting of transverse boards rests on these girders. On the whole the entire resistance moment against torsion should thus be absorbed by the assembly unit and consequently an inexpensive structure can be obtained. Finally the lifting force required in connection with this structure is reduced to one half, as one needs to lift only one lateral beam at a time. On the other hand this makes it possible to use a section which is twice as heavy, in case the same lifting gear is used. The structure according to the present invention makes it possible to erect boat bridges and bathing bridges by two men with the usual hand tools and perhaps a couple of jacks. The structure is well adapted for quick assembly and disassembly.

The invention will be explained in greater detail hereafter with reference to the annexed drawing, in which.

Figure 1:
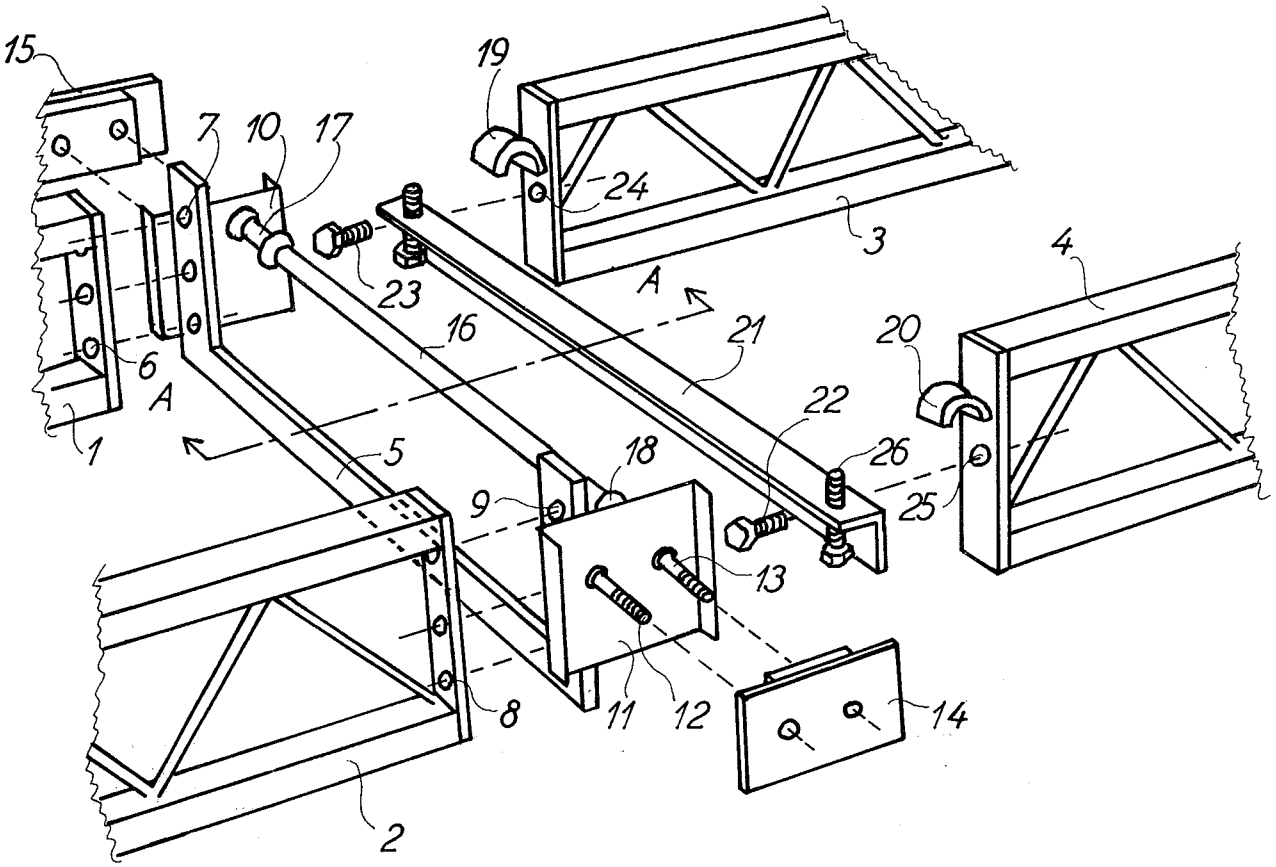
FIG. 1 shows a perspective view of some of the parts of an assembly unit in an exploded position.
Figure 2:
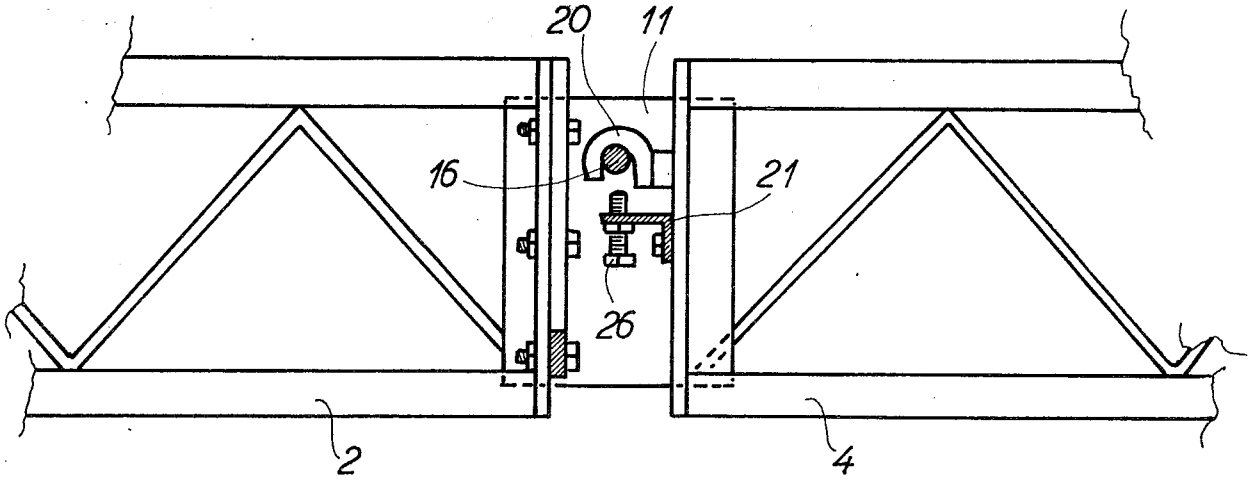
FIG. 2 shows a side elevation view of an assembly according to the invention.

In FIG. 1 the numerals 1 and 2 indicate the ends of two lateral beams of a first bridge section. The numerals 3 and 4 show the adjoining ends of another section. A cross beam 5 is arranged for attaching to the ends 1 and 2 of the first section e.g. through bolt holes 6, 7, 8 and 9. The cross beam 5 is provided with end plates 10 and 11, which are arranged for the attachment of supporting legs by means of bolts 12 and 13, plates 14 and 15 etc. The cross beam 5 is provided with a transverse axle 16, which is attached at its ends to the end plates 10 and 11. The ends of the axle 16 are provided with bearing bushes 17 and 18, each constituting one half of a bearing so that the axis of the axle will become a hinge axis. The ends 3 and 4 of the other section are provided with bearing brackets 19 and 20, whose mutual distance corresponds to the distance between the bushes 17 and 18 and whose bearing surfaces match the outer surfaces of the bushes. A transverse rail 21 consisting of an angle iron is arranged for bolting to the other section by means of screws or bolts 22 and 23 through holes 24 and 25 in order to provide a locking of the hinge by means of lock screws 26 and 27. This is illustrated in FIG. 2, in which the individual parts have the same reference numbers.

Figure 3:
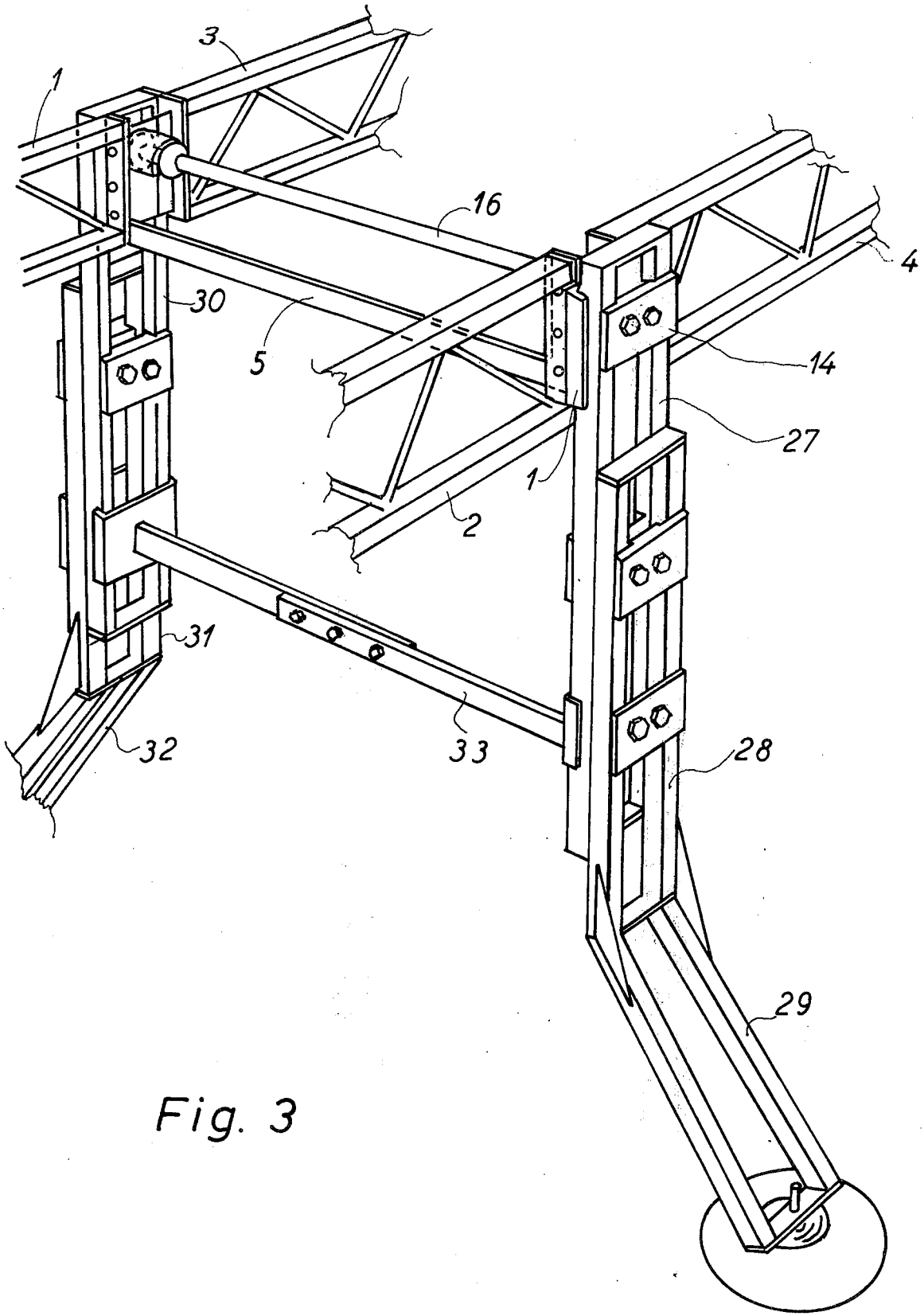
FIG. 3 is a perspective view of an assembly according to the invention.

FIG. 3 shows the assembled parts in a perspective view, and an upper supporting leg 27 consisting of two parallel girders is bolted between the plates 11 and 14. The upper supporting leg 27 is displaceably connected to a lower supporting leg 28, which has a lower outwardly deflected part 29. In a corresponding manner an upper supporting leg 30 and a lower supporting leg 31 with a deflected part 32 is attached to the other end of the cross beam 5. The lower part of the upper supporting leg 27 and 30 is connected to another cross beam 33 to provide a rigid frame structure consisting of the two cross beams 5 and 33 and the two upper supporting legs 27 and 30.

The assembly of the bridge takes place in the following manner. Referring to FIG. 1 the ends 1 and 2 are to be supported in the correct, final position by suitable means, e.g. by brackets. The cross beam 5 with the associated parts is then attached to the ends 1 and 2. Thereafter the supporting legs 27, 28, 30 and 31 are mounted and attached. The other section with the ends 3 and 4 is now lying on the ground, or on the floor of the sea, in the position which it is to occupy in assembled condition. The ends 3 and 4 can now be assembled or perhaps lifted up one by one and hooked on the transverse axle by means of the bearing brackets 19 and 20. All these parts can be considered as provisionally assembled and one can now continue with the next section, not shown. The transverse rail 21 with the associated parts and the other cross beam can now be mounted.

What is claimed is:

1. A bridge composed of individual sections assembled by means of an assembling unit whose supporting elements comprise two lateral beams, preferably lattice girders, wherein a main cross beam is bolted to the end of one of two adjoining bridge sections attached to the end of the following adjoining bridge section by a hinge means having a substantially horizontal axis, and a substantially vertical supporting leg is attached to each end of said cross beam.

2. A bridge according to claim 1, including means for locking the movement of said hinge.

3. A bridge according to claim 2, wherein the supporting legs are longitudinally adjustable in order to vary the distance between the upper point of attachment and the lower point of support.

4. A bridge according to claim 3, wherein an auxiliary cross beam is positioned underneath said main cross beam for connecting said supporting legs into a firm assembly.

5. A bridge according to claim 4, wherein said supporting legs are deflected at their lower ends so that the interval between said supporting legs increases downwardly.

6. A bridge according to claim 5, wherein an individual section solely consists of two lateral beams in the shape of lattice girders, and a deck consisting of transverse boards is mounted on said girders.

* * * * *